United States Patent [19]

Hamada

[11] Patent Number: 4,603,759

[45] Date of Patent: Aug. 5, 1986

[54] FIRE ESCAPE DESCENDER

[76] Inventor: Akio Hamada, 3-8-10, Momoyamadai, Tarumiku, Kobe, Japan

[21] Appl. No.: 735,937

[22] Filed: May 20, 1985

[30] Foreign Application Priority Data

Jan. 28, 1985 [JP] Japan ..... 60-11010[U]

[51] Int. Cl.[4] ..... A62B 1/10

[52] U.S. Cl. ..... 182/234; 182/235; 182/239; 182/240

[58] Field of Search ..... 182/231-240, 182/71, 72, 193; 185/5-7, 191-193, 73, 71, 72; 188/65.1-65.5, 184, 185; 254/332

[56] References Cited

U.S. PATENT DOCUMENTS

| | | | |
|---|---|---|---|
| 437,091 | 9/1890 | Carr | 182/240 |
| 818,526 | 4/1906 | Davy | 182/239 |
| 910,006 | 1/1909 | Lowy | 182/7 |
| 2,225,177 | 12/1940 | McAlvay | 182/193 |
| 3,946,989 | 3/1976 | Tusda | 182/5 |
| 4,458,781 | 7/1984 | Ellis | 182/234 |

FOREIGN PATENT DOCUMENTS

| | | | |
|---|---|---|---|
| 2528410 | 6/1975 | Fed. Rep. of Germany | 182/239 |
| 51-2100 | 1/1976 | Japan . | |
| 55-54512 | 12/1980 | Japan . | |

*Primary Examiner*—Reinaldo P. Machado
*Assistant Examiner*—Alvin Chin Shue
*Attorney, Agent, or Firm*—Frank J. Jordan; C. Bruce Hamburg; Manabu Kanesaka

[57] ABSTRACT

A fire escape descender capable of controlling the descending speed, thereby ensuring that the escaper can escape from the burning building at a desired speed, wherein the speed controlling is effected either manually or automatically.

4 Claims, 3 Drawing Figures

FIRE ESCAPE DESCENDER

BACKGROUND OF THE INVENTION

1. Field of the Invention

The present invention relates to a fire escape descender, and more particularly, to a fire escape descender capable of controlling the descending speed in escaping from the burning building.

2. Background of the Related Art

There have been many proposals for the braking system used in fire escape, Most of them employ an epicyclic gear whereby the rotation of the brake drum is stepped up so as to obtain a large friction between the brake shoe and the drum, thereby securing an adequate speed at which the escapers safely go down to the ground from the burning building. A typical example of the known device is disclosed in Japanese Publication No. 55(1980)-54512. Another is disclosed in Japanese Kokai (unexamined) No. 51(1976)-2100. However, under these known devices it is impossible to control the descending speed manually by the escapers.

OBJECTS AND SUMMARY OF THE INVENTION

The present invention is directed to solve the problems pointed out above, and has for its object to provide a fire escape descender capable of controlling the descending speed either manually or automatically.

Other objects and advantages of the present invention will become more apparent from the following description when taken in conjunction with the accompanying drawings which shows, for the purpose of illustration only, one embodiment in accordance with the present invention.

According to the present invention, there is provided a fire escape descender which comprises:

a base plate;

a shaft fixed to the base plate;

a pulley rotatively supported on the fixed shaft;

an epicyclic gearing on the front surface of the pulley, the epicyclic gear including a sun gear and a planet gear;

a braking shaft secured to the sun gear so that the braking shaft rotates in association with the rotation of the sun gear;

a brake drum applying a brake on the braking shaft so that the rotating speed of the sum gear is reduced;

a sleeve secured to the braking shaft, the sleeve including a plate projecting toward the brake drum;

a brake shoe slightly spaced from the inner surface of the brake drum, the brake shoe including a slot for receiving the tip portion of the plate therein so that when the plate is rotated the brake shoe is driven into rotation;

a brake disc secured to the pulley the brake disc being rotatively supported on the fixed shaft; and a hand brake shoe slightly spaced from a lower part of the brake disc, the hand brake shoe including a pair of links coupled to a pair of bars pivotally secured to the base plate; the bars including a pair of handles operable by the escaper, and also including crooked portions each of which has a first means for holding a hanging rope, and a second means for holding a rope securing the escaper therewith.

DETAILED DESCRIPTION OF THE PREFERRED EMBODIMENT

Figure 1:
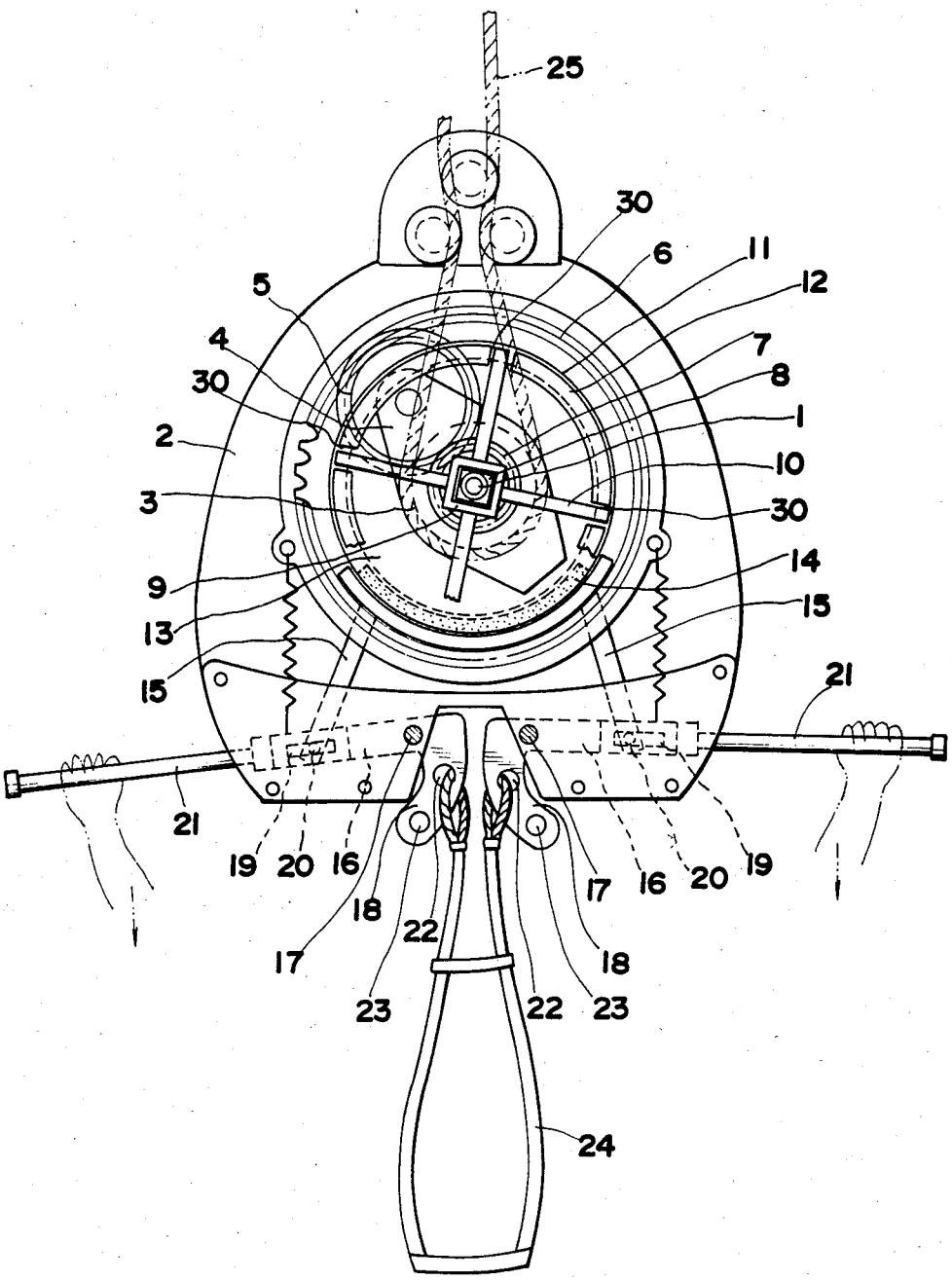
FIG. 1 is a front view showing a fire escape descender embodying the present invention.
Figure 2:
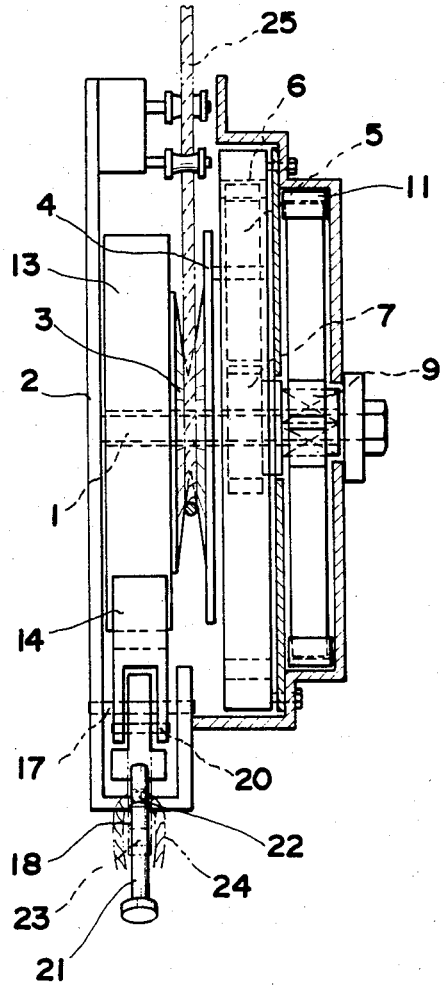
FIG. 2 is a sectional side view taken vertically through the descender of FIG. 1.

As best shown in FIG. 2, the descender has a rear plate 2, and a fixed shaft 1 erected thereon. The reference numeral 3 designates a pulley rotatively supported on the shaft 1. The pulley 3 has a front plate 4 to which a planet gear 5 is pivotally connected. The reference numeral 6 designates an internal gear along which the planet gear 5 rotates. The reference numeral 7 designates a sun gear rotatively supported on the shaft 1, the sun gear being in mesh with the planet gear 5. There is provided a rectangular braking shaft 8 secured to the sun gear 7. The braking shaft 8 is enclosed by a rectangular sleeve 9, which is provided with plates 10 radially outwardly projecting from the sides thereof. The reference numeral 11 designates a brake drum located outside of the top ends of the plates 10. There is provided a brake shoe 12 adapted to act against the brake drum 11, wherein the brake shoe 12 has slots 30 for receiving the top ends of the plates 10 therein. When the plates 10 are rotated, the brake shoe 12 is urged or driven into rotation.

Figure 3:
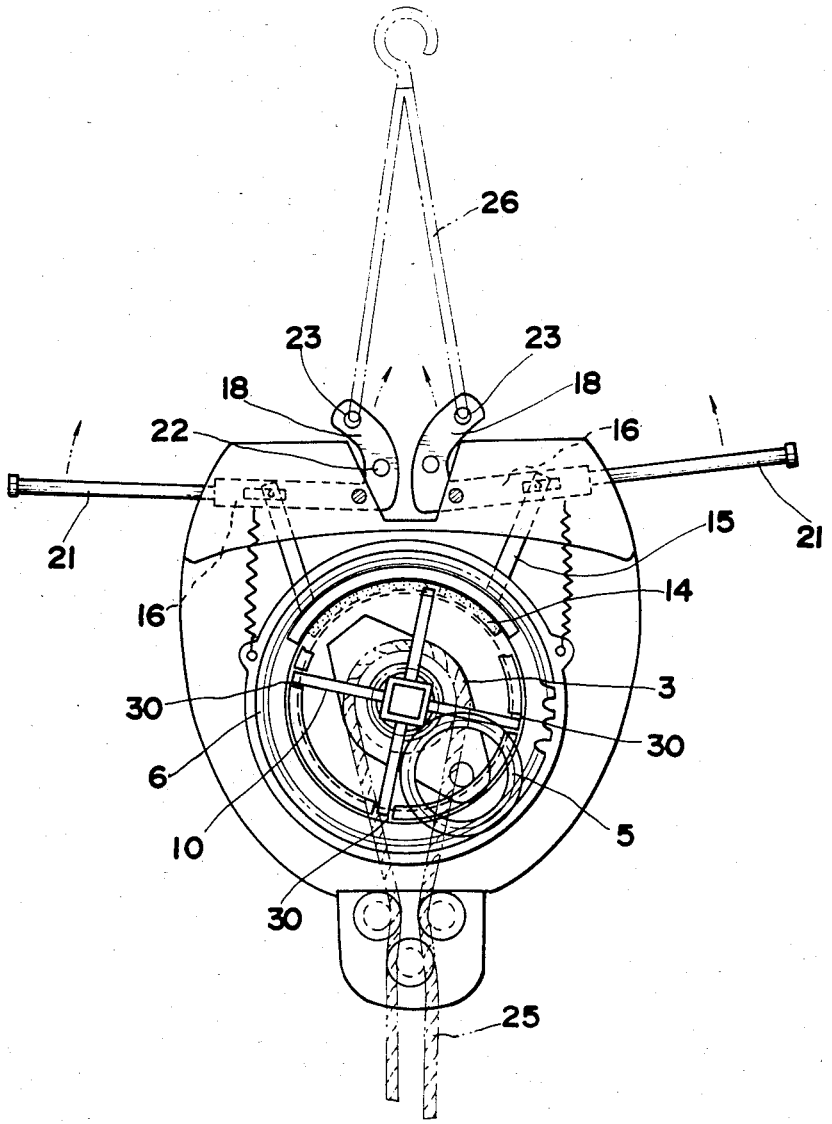
FIG. 3 is a front view showing the descender hung in the upsidedown posture.

There is provided a brake disc 13 which is secured to the back of the pulley 3, and is rotatively supported on the shaft 1. The reference numeral 14 designates a hand brake shoe which is coupled to a pair of bars 16 by means of links 15, the bars 16 being pivotally secured to the rear plate 2 by means of pivots 17 so that the bars 16 swing about the pivots 17. The bar 16 includes a handle 21 and a crooked portion 18, which functions as a lever. Each of the crooked portions 18 is provided with a hole 23 for holding a rope 26 therein (FIG. 3). The rope 26 is used to having the descender on a structure, such as a building wall. Each bar is provided with a second hole 22 in which a belt 24 is held. The reference numeral 25 designates a descending rope carried on the pulley 3.

In operation one end of the descending rope 25 is fastened to the structure, such as a building wall, and the escaper secures his body to the belt 24 so as to allow him to hang thereon.

At this stage the bars 16 are urged downward about the pivots 17 by the escaper's weight. This movement causes the links 15 to rise, thereby urging the brake shoe 14 into contact with the outer peripheral surface of the brake disc 13. In this way the brake disc 13 and accordingly, the pulley 3 are stopped from rotation. The descending action stops. Then the escaper holds the handles 21, and pulls them downward. The bars 16 are lowed down about the pivots 17, thereby causing the links 15 to lower. In this way the brake shoe 14 comes out of contact with the brake disc 13. The brake disc 13 and the pulley 3 are enabled to rotate, thereby letting out the descending rope 25. When the descending speed is too fast, the pulley 3 and accordingly the planet gear 5 rotates fast. This makes the sun gear 7 rotate at an equally increased speed, thereby causing the braking shaft 8 to rotate. In this way the radial plates 10 are rotated through the rotation of the sleeve 9, thereby causing the brake shoe 12 to rotate along the inner surface of the brake drum 11. While in fast rotation, the brake shoe 12 comes into contact with the inner surface of the brake drum under the centrifugal action. Thus the radial plates 10 are braked to slow down, which reduces the rotating speed of the sleeve 9, and accordingly of the pulley 3. In this way the descending speed is controlled so as to secure a safety speed.

When no manual control is needed, the descender is used in the upside down posture as shown in FIG. 3, wherein the descender is hung on the structure by means of the rope 26. When the rope 26 is hung on the structure and the escaper holds the rope 25, the inner ends of the bars 16 are lowered about the pivots 17, thereby pulling the links 15 upward. Thus the brake shoe 14 comes out of contact with the brake disc 13. In this case it is not necessary to use the handles 21, and the speed control is effected solely by the brake shoe 12 in the aforementioned manner.

What is claimed is:

1. A fire escape descender, comprising:

a base member including a shaft fixed to the base member, a rotating member rotationally disposed on the shaft, said rotating member being adapted to engage a rope so that the rope and the rotating member are associated together, a gear mechanism connected to the rotating member to allow the gear mechanism to rotate together with the rotating member, automatic brake means including a brake drum connected to the base member, a brake actuating member connected to the gear mechanism to rotate together with the gear mechanism, and a brake shoe engaging the brake actuating member so that as the brake actuating member rotates faster, frictional engagement of the brake shoe relative to the brake drum increases, manual brake means including a brake disc connected to the rotating member to rotate together with the rotating member, and a hand brake shoe movably fixed to the base member adjacent to the brake disc, manual brake actuating means pivotally connected to the hand brake shoe and including a pair of handle sections, each having a handle and a crooked portion connected to the handle, said crooked portions being pivotally connected to the base member to face relative to each other so that when the handles are lowered down, the hand brake shoe is moved away from the brake disc, a body support member connected to the crooked portions so that when an escaper is held by the body support member, the manual brake actuating means is automatically operated to engage the hand brake shoe to the brake disc to stop moving of the escape descender relative to the rope until the hand brake shoe is released from the brake disc by operating the handle sections, and a descender support member connected to the crooked portions so that when the escape descender is hung by means of the descender support member, the hand brake shoe is released from the brake disc to thereby control movement of the rotating member and the rope only by the automatic brake means.

2. A fire escape descender according to claim 1, in which said gear mechanism comprises an internal gear fixed to the base member, a planet gear rotationally connected to the rotating member and engaging the internal gear, and a sun gear rotationally retained on the shaft and engaging the planet gear so that when the rotating member rotates, the sun gear rotates as well.

3. A fire escape descender according to claim 2, in which said brake actuating member of the automatic brake means includes a braking shaft connected to the sun gear, and a sleeve secured to the braking shaft and having a plurality of plates extending toward the brake drum, the plates engaging said brake shoe so that when the sun gear rotates, the brake shoe is urged toward the brake drum by centrifugal force to thereby provide frictional engagement therebetween.

4. A fire escape descender according to claim 3, in which said manual brake actuating means further includes links, each situated between the hand brake shoe and the crooked portion, and springs connected to the crooked portions to urge the handle sections toward the brake disc.

* * * * *